US005359144A

United States Patent [19]

Benson

[11] Patent Number: 5,359,144

[45] Date of Patent: Oct. 25, 1994

[54] PITCH CHANGING APPARATUS FOR STRINGED INSTRUMENT TREMOLO

[76] Inventor: Robert Benson, 8002 San Luis Cir., Buena Park, Calif. 90620

[21] Appl. No.: 65,199

[22] Filed: May 21, 1993

[51] Int. Cl.[5] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 4,171,661 | 10/1979 | Rose | 84/313 |
| 4,497,236 | 2/1985 | Rose | 84/33 |
| 4,869,145 | 9/1989 | Evans | 84/313 |
| 4,928,564 | 5/1990 | Borisoff | 84/313 |
| 4,944,208 | 7/1990 | Kusek | 84/313 |
| 4,967,631 | 11/1990 | Rose | 84/313 |
| 4,984,493 | 1/1991 | Schaller | 84/313 |
| 5,083,492 | 1/1992 | Gorr | 84/313 |
| 5,127,298 | 7/1992 | Snape et al. | 84/313 |
| 5,194,679 | 3/1993 | Cohen | 84/313 |
| 5,198,601 | 3/1993 | McCabe | 84/313 |

*Primary Examiner*—William M. Shoop, Jr.
*Assistant Examiner*—Jeffrey W. Donels

[57] ABSTRACT

A pitch changing apparatus, providing bi-stable operation within a tremolo system which produces two distinct pitches for selected strings. The apparatus includes a shifting element 56, which is engagable to introduce or remove a pre-determined thickness within a tremolo system, creating string tensions relative to chosen, distinct pitches. An established ratio of total string tension and opposing spring counter-tension acting upon a tremolo is maintained by a tension correcting mechanism 73. The tension correcting mechanism is manually rotated to adjustable stop positions of required spring counter-tension, thereby keeping all strings in tune under conditions of changed total string tension.

24 Claims, 10 Drawing Sheets

PITCH CHANGING APPARATUS FOR STRINGED INSTRUMENT TREMOLO

BACKGROUND-FIELD OF THE INVENTION

This invention relates generally to tremolo devices for stringed instruments, and more particularly with a novel apparatus which complements both tremolo systems and fine tuning mechanisms therein, making possible rapid tuning changes, and adapting for the resulting change in tensions, maintaining a ratio of forces acting upon the tremolo to insure proper pitch for all strings of the instrument.

BACKGROUND OF PRIOR ART

A tremolo condition known as floating, wherein the tremolo base is suspended about its pivotal points a short distance above the top of the instrument, allows simultaneous changes of pitch for strings, greatly decreasing or increasing the pitch as operated. It is known to those in the guitar technical field that a normal, non-use position of a floating tremolo is dependent upon the ratio of opposing forces acting upon the tremolo. This position is the result of tensions exerted by pitch tuned strings opposing spring counter-tension. Any change of normal string force will alter the normal position, as well as the pitch of the remaining strings. Therefore, changing pitch of selected individual strings for tunings other than normal is a problem concerning the tremolo.

A tremolo system utilizing the combination of a string clamping device and a tremolo base equipped with an independent fine tuning element for each string, is set forth by U.S. Pat. No. 4,171,161, and U.S. Pat. No. 4,497,236, both issued to Floyd Rose. In this tremolo system the strings are fastened immediately behind contact points at the nut and bridge, resulting in a reduction of string drag, the primary cause for failure in restoring pitch.

An instrument equipped with this tremolo system is pitch tuned first by the tuning pegs. The strings are then clamped at the nut region, requiring further pitch tuning adjustments to be made by the fine tuning elements. Although primarily used for pitch tuning adjustments, it has been found that an average fluctuation of over a full step, or whole tone in pitch can be performed by the fine tuning element.

U.S. Pat. No. 4,984,493 issued to Helmut F. K. Schaller, describes a counter-tensioning mechanism which replaces the standard spring anchor assembly of a tremolo. This apparatus allows the adjustment of spring tension for a change in string tension introduced by replacing existing strings with strings of a different gage, without having to remove the back cover plate. The mechanism is accessible for adjustment through a hole provided in the cover plate.

Although this invention simplifies the procedure for adjusting spring tension, the repetition of tuning and readjusting spring tension required for adjusting the tremolo to return the normal position is not eliminated, and remains a time consuming task.

Another device for the control of spring tension is described in U.S. Pat. No. 4,928,564 issued to David J. Borisoff. This apparatus is used for improved stabilization with stoppable adjustment for increased tremolo firmness. The apparatus replaces the central counter-tension spring and requires the removal of the spring anchor.

This invention serves to stiffen the playing action of a guitar with a tremolo, which may be preferred by some players. U.S. Pat. No. 4,928,564 refers to prior art U.S. Pat. No. 4,171,161 and U.S. Pat. No. 4,497,236 issued to Floyd Rose as being inadequate for the return of proper pitch to an instrument after tremolo operation, requiring added stabilization to function properly. It has been found, however, that this is not the case; added stability may be a positive aspect, but is not necessary to maintain pitch tuning for an extended length of time. A more flexible playing action may be preferred, especially when a heavier gage of strings is used to improve the tone of the instrument.

Accordingly, it is a primary object of the present invention to improve a tremolo system by providing novel operation for rapid and accurate alternate pitch changing of selected strings of a musical instrument, and further to adapt spring counter-tension relative to a change in force exerted by the strings by the altered pitch, maintaining proper pitch for those strings not pitch changed.

It is yet another object of the present invention to provide stoppable operation for adapting spring counter-tension, corresponding to changes of force introduced by alternate pitches and substitution of different gages of strings.

It is yet another object of the present invention to implement all existing hardware of a tremolo system, with only the addition of the apparatus of the present invention needed for operation.

Further objects and advantages will become apparent from a consideration of the drawings and ensuing description.

DESCRIPTION OF DRAWINGS

In the drawings, closely related figures have the same number, but different alphabetic suffixes.

SUMMARY OF INVENTION

Accordingly, the present invention is an apparatus which enables bi-stable operation within a tremolo system, engagable to produce two distinct pitches for desired strings. A rear segment of a chosen fine tuning element is slidable to either of two pre-set positions, creating string tensions to producing either of two distinct pitches, each accurate in pitch tuning, while allowing fine tuning capability in both positions. The apparatus also serves to appropriately lengthen counter-tension springs, providing proper tension required to maintain established ratio of spring counter-tension to the overall force exerted by the strings, with the resulting change in spring tension. Thus, proper pitch tuning is insured for the remaining, non-pitch changed strings, as well as a normal, non-use position of the tremolo.

DESCRIPTION OF INVENTION

Figure 1:
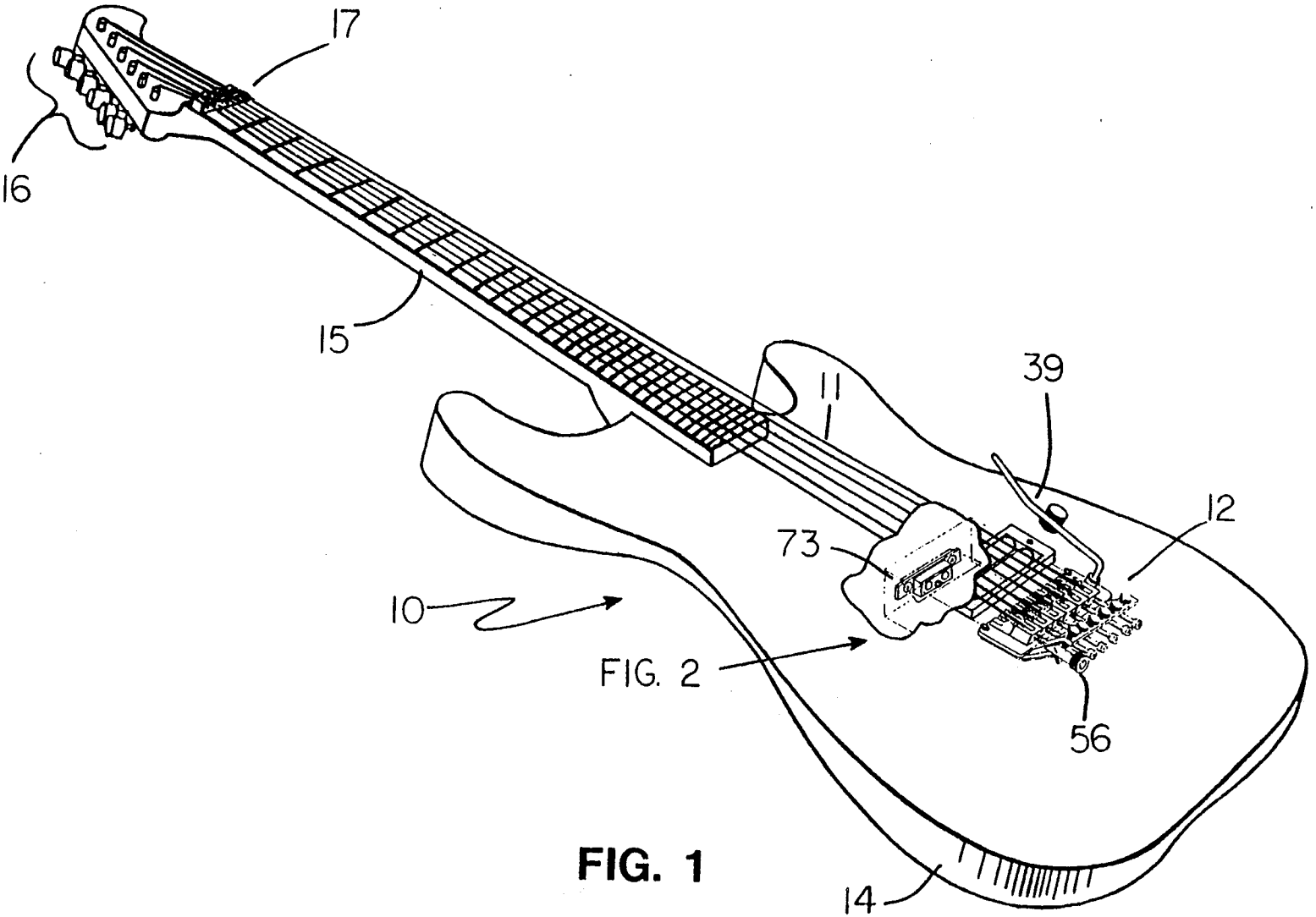
FIG. 1 is a perspective view showing the present invention mounted to an electric guitar.

FIG. 1 shows the position of the present invention; a shifting element 56 and a tension correcting mechanism 73, both generally located on a tremolo 12 of an electric guitar 10. Electric guitar 10 generally includes a plurality of strings 11 stretched over a body 14, and a neck 15. Located at the nut region is a string clamping device 17, and above are the tuning pegs 16.

The present invention is described and shown on an electric guitar, but it should be understood that use for any stringed instrument with a tremolo is implied. The electric guitar has the widest application for the tremolo, and therefore is so described.

Further, the tremolo system described and shown in the ensuing description refers to a specific tremolo bridge which implements fine tuning mechanisms and provides for their function. This combination offers the widest application of the present invention, but it should be understood that use with suitable tremolos is implied; the tension correcting mechanism 73 may be used with tremolos that do not include fine tuning mechanisms.

Figure 2:
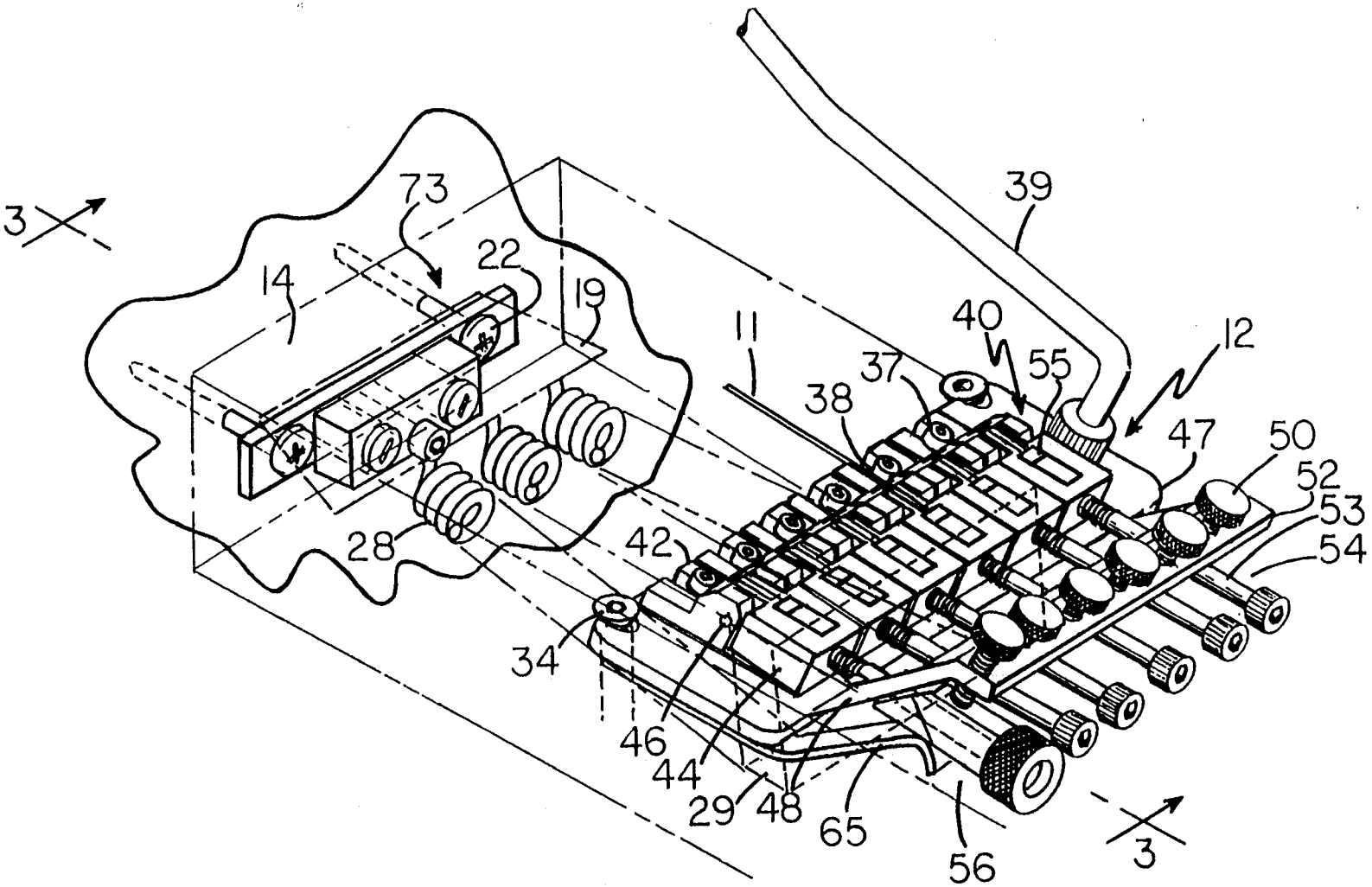
FIG. 2 is a detailed larger scale view taken from the bridge area of the guitar of FIG. 1.
Figure 3:
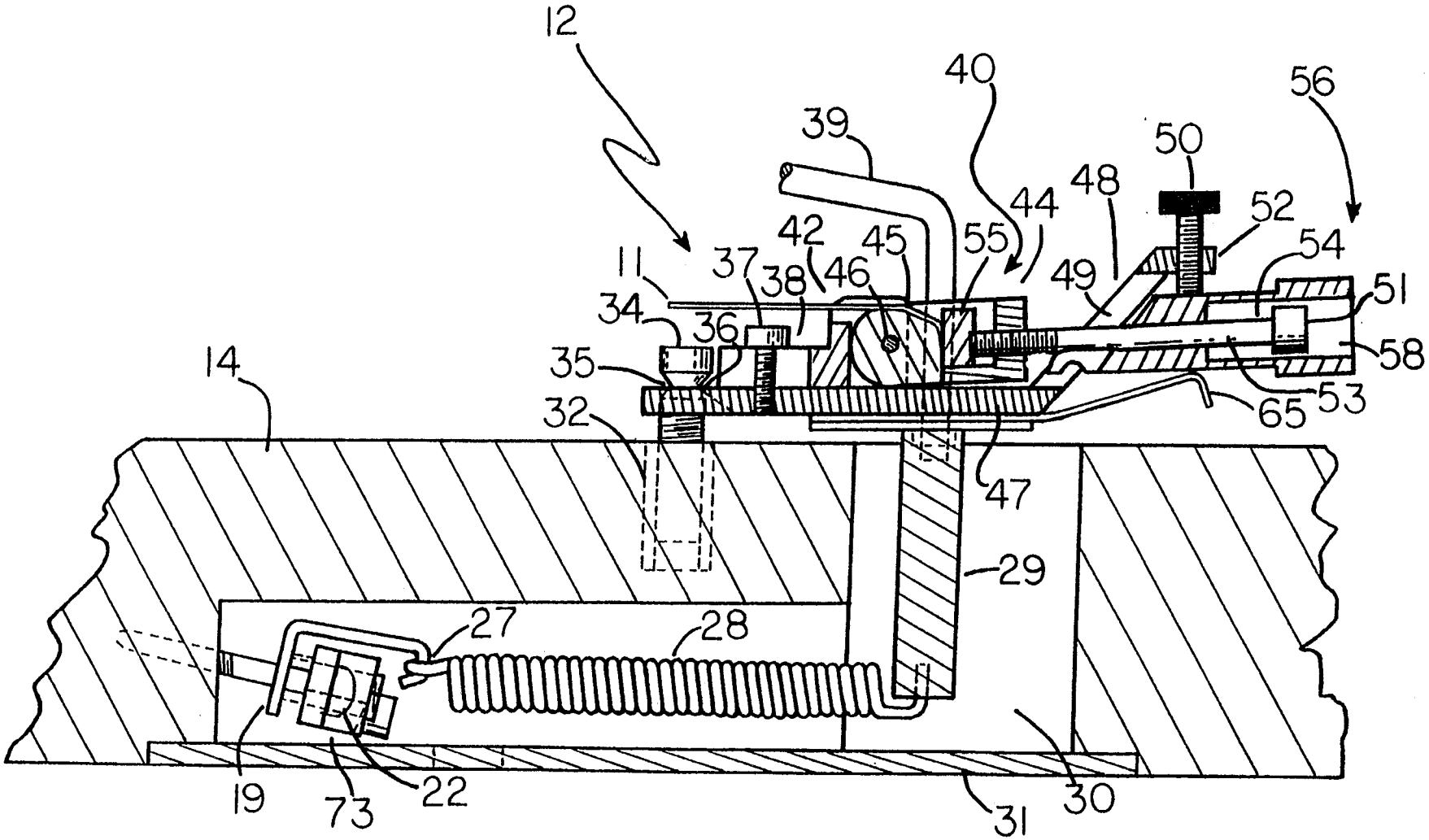
FIG. 3 is a cross-sectional view taken along lines 3—3 of FIG. 2.

Referring to FIGS. 2 and 3, the present invention is shown implemented in combination with a prior art tremolo system. A shifting element 56 is contained by a socket head screw 54, a component of a fine tuning mechanism 40, and a tension correcting mechanism 73 is mounted adjacent to a spring anchor 19 which in turn is connected to a set of counter-tension springs 28.

FIG. 3 shows a tremolo base 47 containing a number of fine tuning mechanisms 40. Knife edges 36 are present on each forward corner, which mate with tapered annular shoulders 35 located near the top of mounting studs 34. The mounting studs 34 are threadably connected in sleeves 32, which are contained by the guitar body 14. A flat, rectangular block 29 extends downwardly from the underside of tremolo base 47 into an elongated hole 30, which spans the width of guitar body 14. A set of counter-tension springs 28 are connected individually by a first end attaching to the bottom of flat block 29, with opposite second ends attaching to hooks 27 of a spring anchor 19. Wood screws 22 fasten the tension correcting mechanism 73 and the spring anchor 19 adjustably to the guitar body 14.

A tremolo control arm 39 secured to the tremolo base 47 allows manual tremolo operation, pivoting the tremolo base 47 and knife edges 36 in tapered annular shoulders 35 of studs 34. Pushing the tremolo arm 39 toward the guitar body 14 releases the tension on the strings, which lowers the pitch of strings played. Conversely, pulling the tremolo arm 39 away from the guitar body 14 increases the string tension, raising the pitch. A normal, non-use position is returned after tremolo operation by stabilization of string and opposing spring forces.

A flange plate 48 extends upwardly at an incline of 45 degrees from the upper surface near the rear of tremolo base 47. A ledge 52 protrudes rearwardly from the upper extremity of flange plate 48, wherein a number of fine tuning adjustment screws 50 are threadably contained.

Each fine tuning mechanism 40 includes a front segment 42 and a rear segment 44, which are pivotally connected by a pin 46. As shown in FIG. 3, a machine screw 37 extends through a slot 38 in the front segment 42 and thereby attaches the fine tuning mechanism 40 at a stationary position to the tremolo base 47. A socket head screw 54 extends through an opening 49 in flange plate 48, and is threaded through the rear of the rear segment 44 and contacts a slidable clamping block 55. The fine tuning adjustment screw 50 rests on a smooth shank 53 of the socket head screw 54. A leaf spring 65 extending rearwardly and upwardly from the underside of the tremolo base 47, exerts an upwardly directed compressional force against the underside of smooth shank 53.

Each string 11 is fastened to the tremolo base 47 by a separate fine tuning mechanism 40, wherein the string arcs over the upper and rear surfaces of a fulcrum portion 45 of fine tuning mechanism 40, and then is clamped between the front fixed segment 42 and the rear pivotable segment 44 by the slidable,clamping block 55. The slidable clamping block 55 is forced against the string by the socket headed screw 54, which is tightened with clockwise rotation by an appropriate tool.

Movement of the fine tuning mechanism 40 parallel to the strings for setting harmonic tuning is allowed by travel of the fine tuning mechanism 40 towards or away from the neck in slot 32. Pitch tuning adjustments are the result of string tension control, achieved by the adjustment of the pivotable position of the rear segment 44 about the front segment 42. Manual rotation of the fine tuning adjustment screw 50 in a clockwise direction pushes the socket head screw 54 and attached rear segment 44 down, increasing the string tension and thereby raising the pitch. Counter-clockwise rotation of the fine tuning adjustment screw 50 raises the pivotal position of the rear segment 44, resulting in a decreased string tension and lower pitch.

Figure 4:
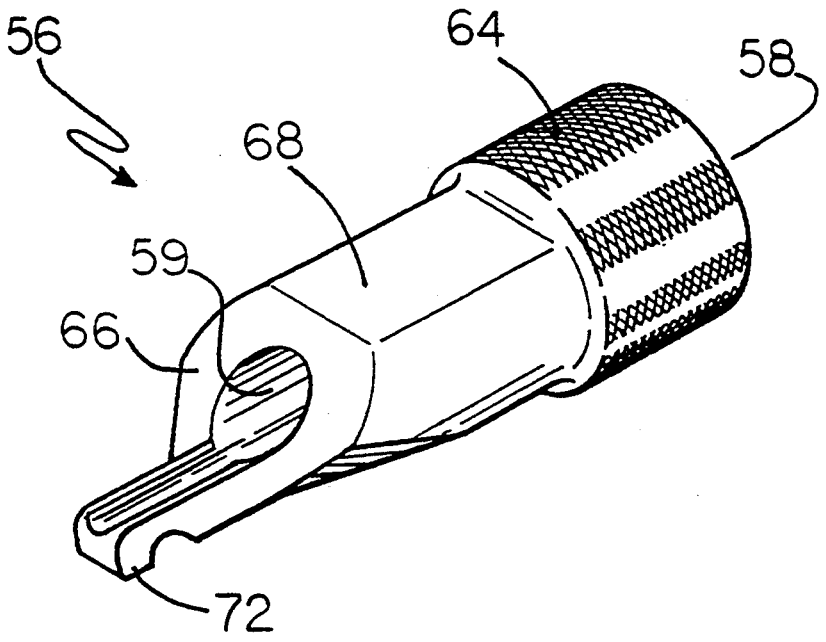
FIG. 4 is a perspective view of a shifting element comprising part of the present invention.

FIG. 4 shows a novel shifting element 56 according to the present invention, which is generally cylindrical in shape. The preferred embodiment shown is made from stainless steel. The length is approximately 28 mm with a 10 mm diameter. A slightly larger diameter longitudinal portion, located at the rear and spanning approximately $\frac{1}{3}$ of the total length, is covered by knurled surface 64. A central bore 59, bored to a diameter slightly larger than the smooth shank 53 of the socket head screw 54, extends lengthwise from the front to a point at mid-length. There a larger clearance bore 58, approximately 7 mm in diameter, extends until terminating at the rear transverse face of shifting element 56. A notched detent tab 72, approximately 6 mm in length and 3 mm in width, is located at the lower front portion of shifting element 56, broadening into a beveled face 66, which extends rearwardly at an incline of 45 degrees. A flat surface 68 begins at the upper terminating point of the beveled face 66 and extends rearwardly, until meeting knurled surface 68. A thickness exists between the top of the central bore 59 and the flat surface 68, which dimension is predetermined according to necessary spacing relative to a selected string and alternate pitch operation.

Figure 5:
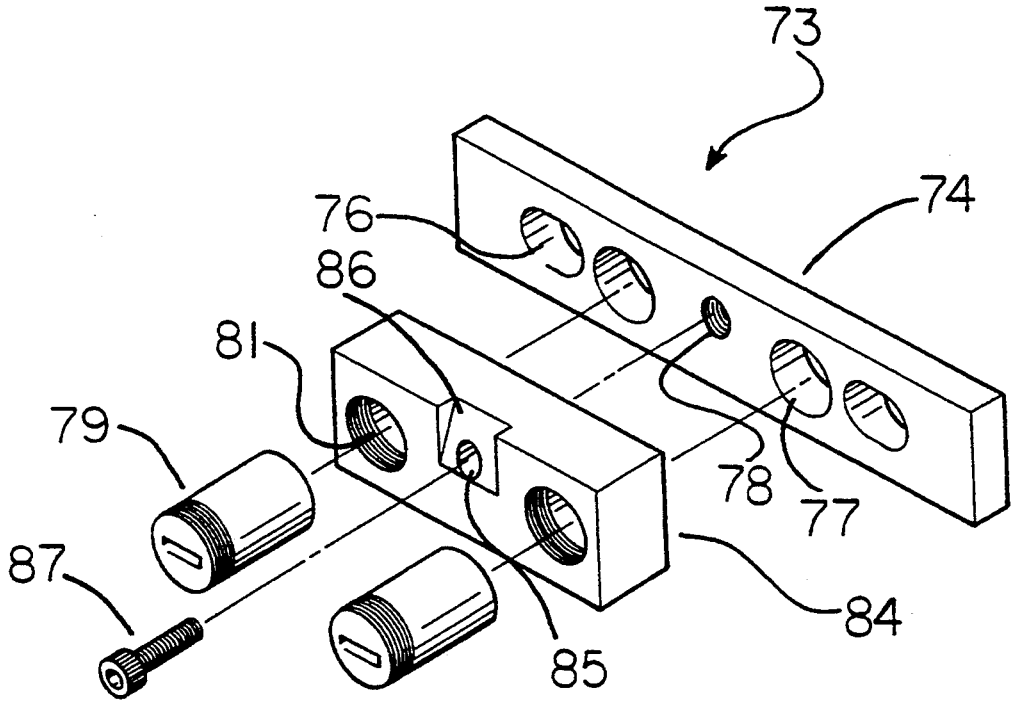
FIG. 5 is an exploded view of tension correcting mechanism comprising a part of the present invention.

FIG. 5 shows the separate elements of the tension correcting mechanism 73, including an elongated base 74, a plunger block 84 with plungers 79, and a draw screw 87. The preferred embodiment shown is also made of stainless steel.

The elongated base 74 is a flat, rectangular plate with a general thickness of 5 mm, long edges with a width of 50 mm, and ends with a height of 10 mm. Centered along the long edges and slightly above mid-height, is a threaded hole 78 of about 4 mm. Holes 77 are approximately 6 mm in diameter, and located at mid-height, about 12 mm on either side of hole 78. Extending horizontally between holes 77 and edges of the elongated base 77, are slots 76, which are approximately 7 mm wide and 4 mm in height.

The plunger block 84 is a rectangular block with a general thickness approximately twice that of the elongated base 74, and with an equal height. The width is approximately one-half that of the elongated base 74. Holes 86, corresponding to, but slightly larger than hole 78, extends through the thickness. A bevel 85, approximately 6 mm wide is located on the front surface, extending upwardly and inwardly from the bottom of hole 86 to the top of plunger block 84.

The plungers 79 are cylindrical in shape, approximately 12 mm long and 6 mm in diameter. The front end is slotted for engagement of a screwdriver. Behind is a threaded portion, which covers the remaining length.

Holes 81 extend through the thickness of the plunger block 84 and are symmetrical, corresponding to holes 77 of the elongated base 74, with the front ⅓ of holes 81 containing threads mating with those on plungers 79.

The draw screw 87 extends through hole 86 of the plunger block 84, and behind is threadably connected to hole 78 of the elongated base 74, which attaches the plunger block 84 with plungers 79 to the elongated base 74. The plungers 79 are inserted into holes 77 and are movable therein. The bottom portion of the head of draw screw 87 contacts the front surface of the plunger block 84 directly below the bevel 85, directing force to a central point.

Figure 6A:
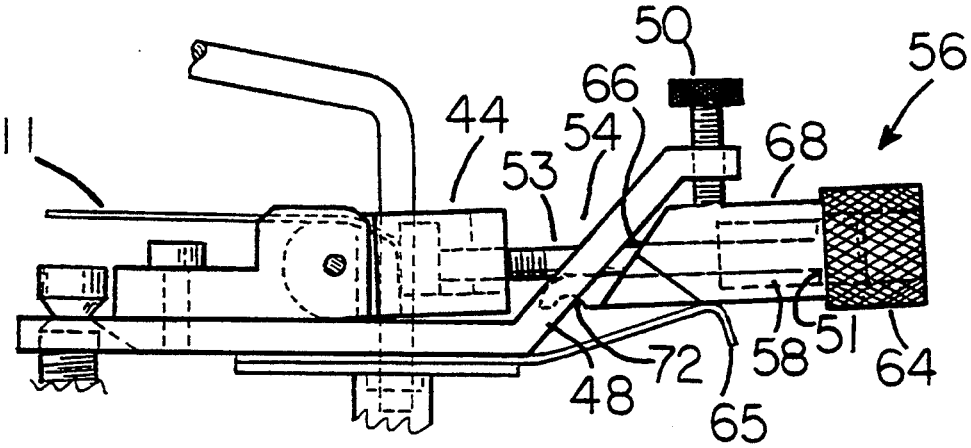
FIGS. 6A through 6D show the operation of the present invention.
Figure 6B:
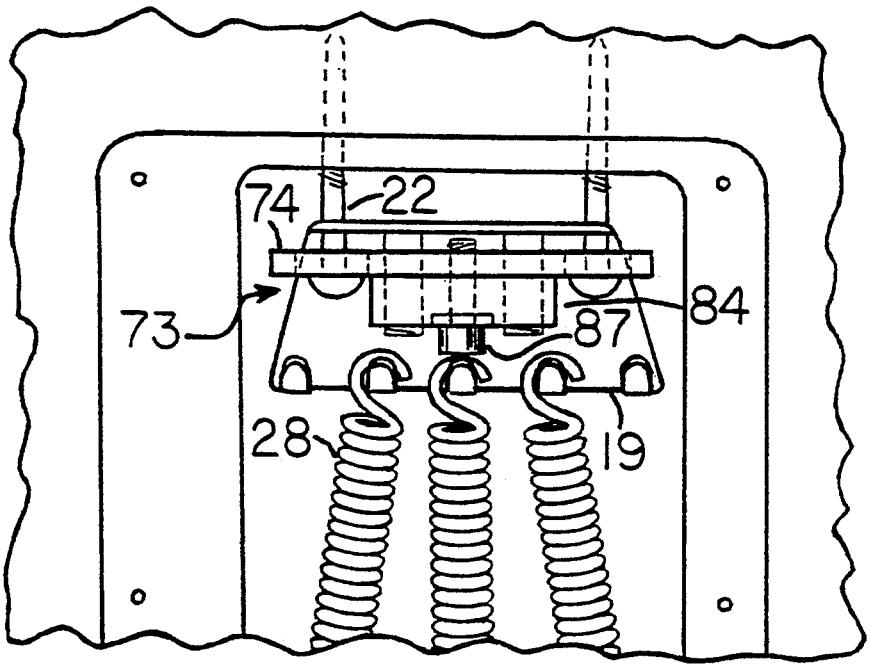
Figure 6C:
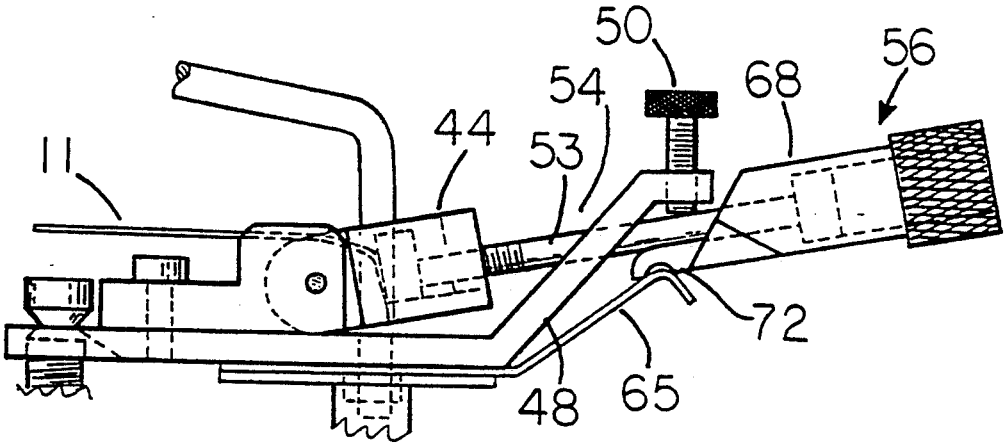

Referring to FIGS. 6A and 6C, the shifting element 56 is implemented within a tremolo system, contained by the socket head screw 54, with the central bore 59 encasing the smooth shank 53 of socket head screw 54. The fit between the two surfaces is snug, while allowing sliding of the shifting element 56 on the socket head screw 54. Manual operation for sliding is assisted by the knurled surface 64. The clearance bore 58 surrounds a head 51 of the socket head screw 54.

As shown in FIG. 6A, movement of the shifting element 56 in a forward direction toward the rear segment 44 of the fine tuning mechanism 40 is limited by contact of beveled face 66 of the shifting element 56 with the back of flange plate 48. As shown in FIG. 6C, movement in a rearward direction is restricted by contact of a front annular wall of central bore 59, with head 51 of the socket head screw 54. Upright position of the shifting element 56 is supported by the leaf spring 65, which engages with the notched tab 72.

FIG. 6A shows the shifting element 56 in a forward position, in which the flat upper surface 68 of the shifting element 56 rests beneath the fine tuning adjustment screw 50. A predetermined thickness existing between the flat upper surface 68 and the top of the central bore 59 is introduced between the smooth shank 53 of the socket head screw 54 and the bottom of the fine tuning adjustment screw 50. The rear segment 44 of the fine tuning mechanism 40 is therefore pivoted downward to a fixed position, creating a condition of increased string tension. Thus, a higher pitch is produced which is determined by the dimension of predetermined thickness.

The thickness required to accurately raise pitch for individual strings is equal to the exact amount of downward movement applied to the rear segment 44 by the fine tuning adjustment screw 50 to obtain an identical pitch. Therefore, if a string has been previously pitch tuned, the higher pitch produced will also be properly pitch tuned.

FIG. 6C shows the shifting element 56 in a rearward position. Upon removal of the predetermined thickness, the rear segment 44 is located in an upward position creating a condition of decreased string tension, and consequently a lower pitch is produced.

Referring to FIGS. 5 and 6B, the tension correcting mechanism 73 is mounted to a tremolo system by the elongated base 74. Wood screws 22 are inserted first through slots 76, and then through the spring anchor 19 before threadably connecting to the guitar body 14. Spring tension pulls against the spring anchor 19, which in turn presses the elongated base 74 against the heads of the wood screws 22, stabilizing the tension correcting mechanism 73

The plunger block 84 with plungers 79 is moved longitudinally with respect to the elongated base 74 by rotation of the draw screw 87. Clockwise rotation of the draw screw 87 extends the plungers 79 beyond the back surface of elongated base 74 and into the spring anchor 19 to position the spring anchor 19 in a direction that stretches the counter-tension springs 28, thereby increasing spring tension. Counter-clockwise rotation of the draw screw 87 retracts the plungers 79, positioning the spring anchor 19 in a direction that releases the counter-tension springs 28, thereby decreasing spring tension.

The plungers 79 are evenly adjusted within the plunger block 54 to control the distance the plungers 79 will extend beyond the back of the elongated base 74, which determines a limit of spring anchor 19 movement and spring tension increase. A first stop position is realized at the point at which the plunger block 84 makes flat contact with the elongated base 74. Thus, a stoppable increase of spring tension is produced, which is controlled by the adjustment of the plungers 79.

FIGS. 6A and 6B show both elements of the present invention in a condition which produces a higher pitch. Upon the introduction of increased string tension to the total force exerted the strings on a tremolo, spring counter-tension is also increased by the tension correcting mechanism 73. This increase is realized at the stop position shown, and is the exact amount necessary to return pitch tuning to all of the strings. The increase of spring counter-tension also directly relates to re-establishing a normal position of the tremolo, which is realized at the same stop point.

Figure 6D:
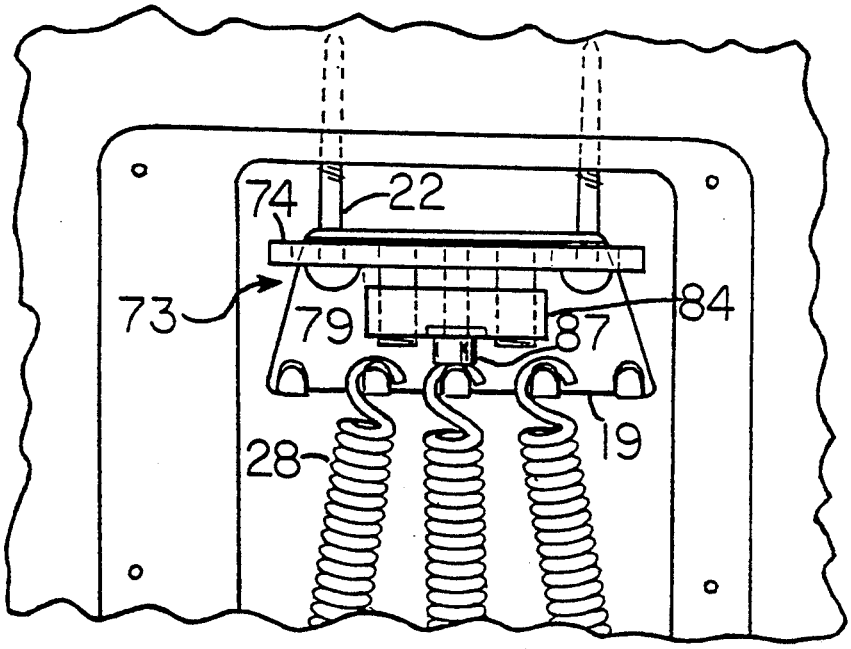

FIG. 6C and 6D show both elements of the present invention in a condition which produces a lower pitch. Upon the removal of the increased string tension, spring counter-tension is also decreased by the tension correcting mechanism 73. At this stop position all strings are pitch tuned, and the established normal position of the tremolo is returned.

ALTERNATE EMBODIMENTS

Although a preferred embodiment has been shown and described, other embodiments, as well as additional hardware within the spirit of the invention may also be implemented.

Figure 7A:
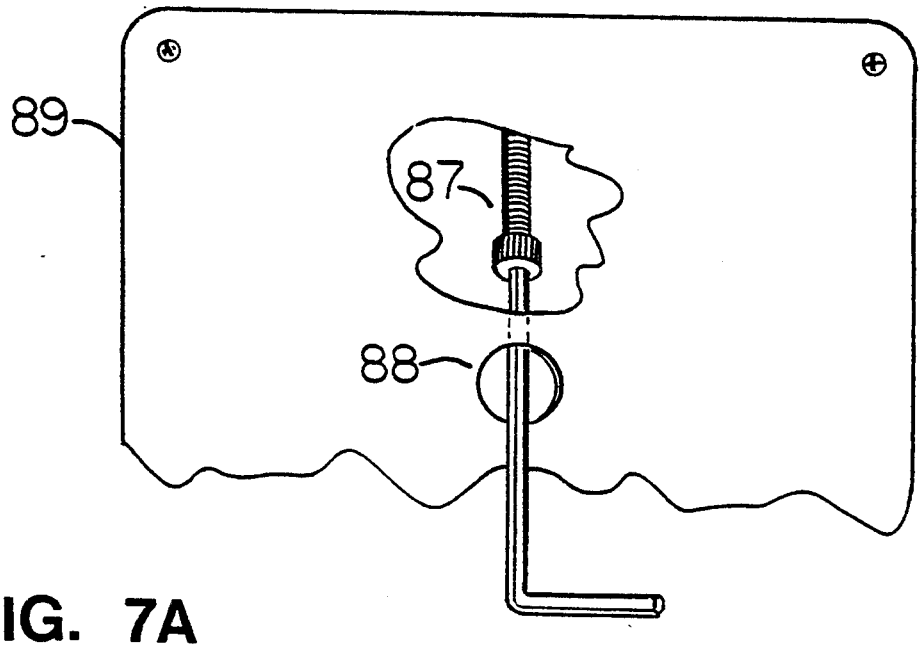
FIGS. 7A through 7C show alternate embodiments of a part of the present invention.

FIG. 7A shows the position of a hole 88 in a cover plate 89 providing accessibility for engagement of an appropriate tool for rotation of draw screw 87. As the apparatus is mounted at a slight angle, hole 88 is located accordingly.

Figure 7B:
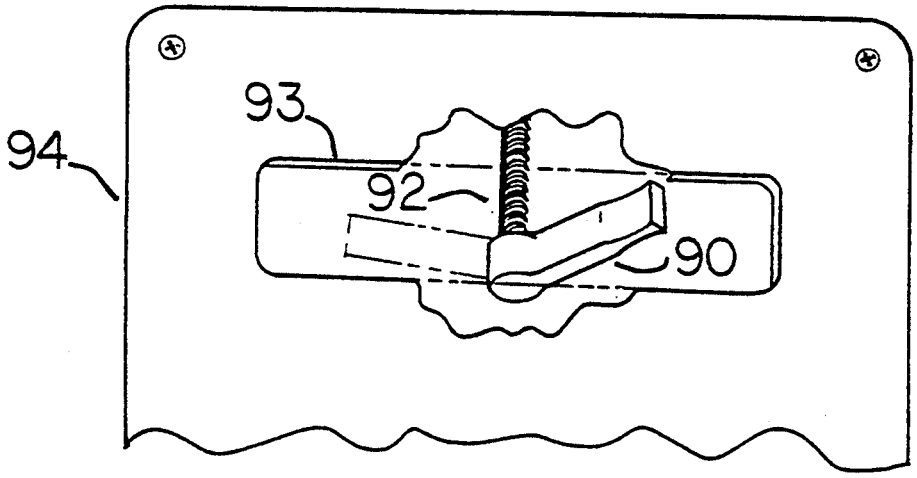

FIG. 7B shows another method for rotation, requiring approximately ½ of a revolution of a lever 90 for operation. The lever 90, which is attached to a coarsely threaded shank 92, is accessible through a rectangular opening 93 in cover plate 94. The coarsely threaded shank 92 implemented with mating threads of the apparatus, provides operation to both stop positions, with the lever 90, which eliminates the need of a separate tool.

Figure 7C:
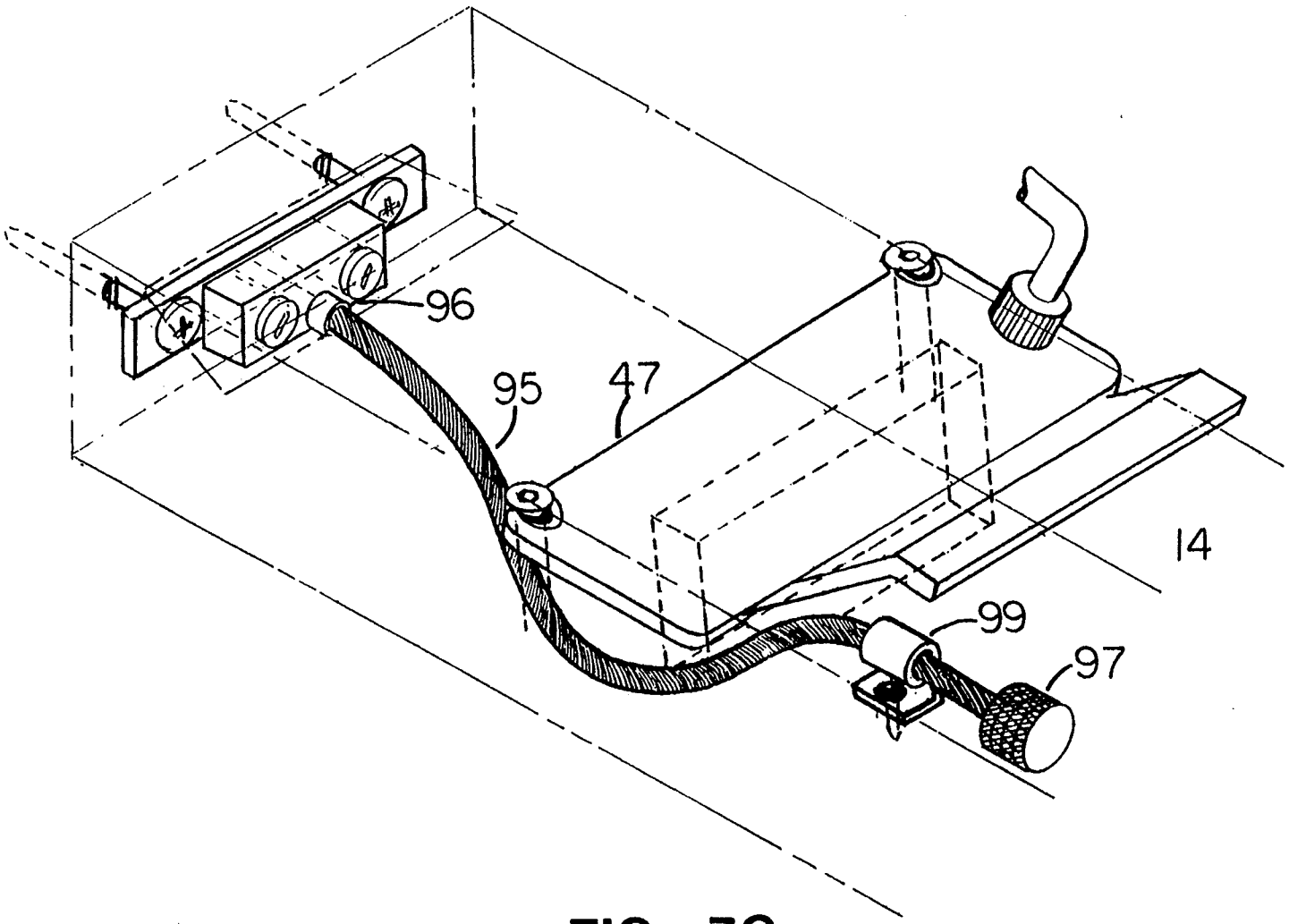

FIG. 7C shows a method for complete operation of the tension correction mechanism 73 from the top of an instrument, without a separate tool, in which rotation is carried from a knob 97 through a flexible cable 95 attached to a screw 96. The cable 95 is routed so as to not interfere with tremolo operation, and is guided by a sleeve 99, which also positions the cable 95 above the instrument to approximately parallel with the instrument.

Figure 8A:
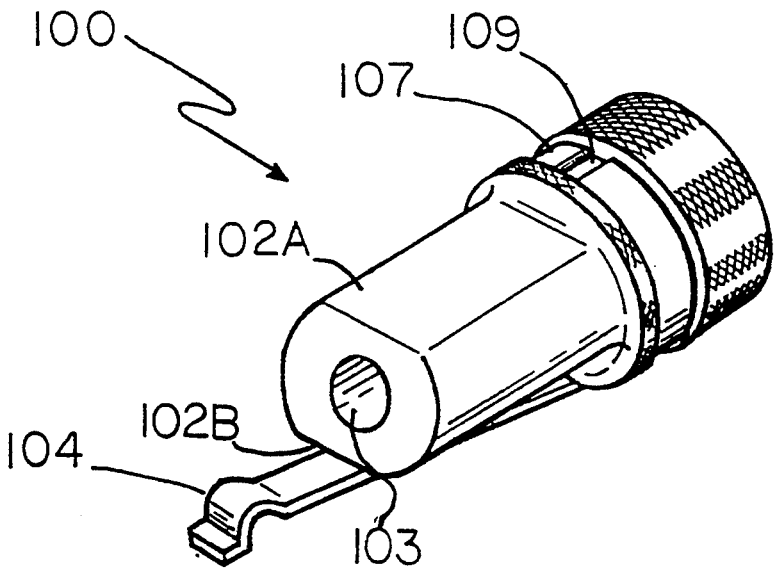
FIG. 8A and 8B show components of a multi-stage pitch changing apparatus.
Figure 8B:
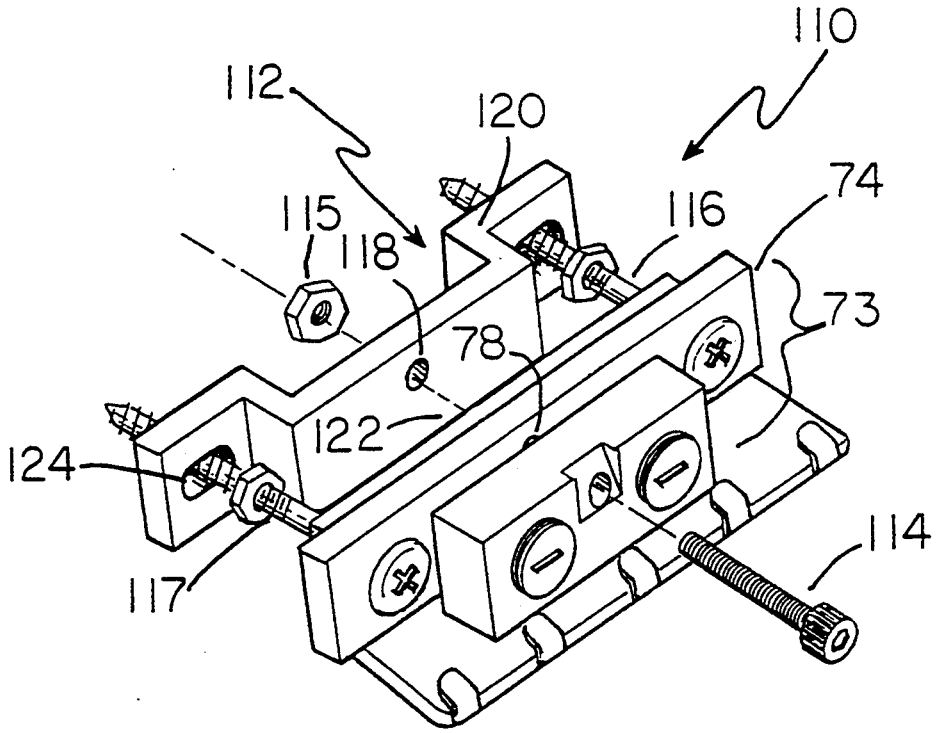

FIGS. 8A and 8B show an embodiment of an apparatus which can be implemented within a tremolo system to provide three distinct pitches.

FIG. 8A shows a multi-faceted, or tristable shifting element 100, which is similar to the preferred embodiment, but includes more than one predetermined thickness, provided by flat surfaces 102A and 102B. The flat surfaces 102A and 102B each provide a separate predetermined thickness, being at different distances from the perimeter of a central bore 103. A tab 104 which extends from a rotatable ring 107 is attached in a slot 109 located behind flat surfaces 102A and 102B.

A chosen flat surface, 102A for example, is positioned upwardly, with the tab 104 located downwardly, for engagement within a tremolo system. A distinct pitch thereby produced is determined by the string tension created by the introduction of a chosen predetermined thickness. A different predetermined pitch change is effected by rotating the shifting element 56 180 degrees, positioning surface 102B upwardly.

FIG. 8B shows a multiple tension correcting mechanism 110, for use with tristable shifting element 100, which provides three stoppable positions for spring counter-tension. Included is the preferred embodiment tension correcting mechanism 73, referred to as the primary stage, responsible for two stop positions; a position of increased spring counter-tension, and also a position of decreased spring counter-tension. The addition of a secondary base 112 provides a third position for further increased spring counter-tension.

The multiple tension correcting mechanism 110 includes wood screws 116, lock-nuts 115, an extended draw screw 114, in addition to the primary stage 73 and secondary base 112. The secondary base 112 has a general thickness of 5 mm and a height of 10 mm. The total width is approximately 50 mm, a majority of which is a front portion 119 of about 30 mm, A clearance hole 118 corresponds to hole 78 of the elongated base 74, but is slightly larger than hole 78 to allow passage of the draw screw 114. An L-shaped flange 120 extends rearwardly from the outer edges of the front portion 119 approximately 8 mm, before turning outwardly, parallel with front portion 119. Slots 124 are located on flanges 120 corresponding to slots 76 of the elongated base 74. Wood screws 116 include a machine thread portion 117 on the lower shoulder, mating with threads of lock-nuts 115.

The multiple tension correcting mechanism 110 is mounted to an instrument with wood screws 116 extending through the elongated base 74 and spring anchor 19. Lock-nuts 115 are then threaded onto threads 117. Wood screws 116 are finally inserted through slots 124, before threadably connecting to the instrument. The draw screw 114 is inserted through the primary stage 73, rotated so as to extend through hole 78, and a hole 122 which is furnished in a corresponding position on the spring anchor 19, before finally extending through hole 118 of the secondary base 112. The draw screw 114 is of sufficient length to extend through all elements before the head comes in contact with the primary stage 73. Finally lock-nut 115 is threaded onto draw screw 114.

A stop position for further increased spring counter-tension is adjusted by lock-nuts 115. Equal rotation of lock-nuts 115 on threads 117 determines the amount of travel the entire primary stage 73 and spring anchor 19 will achieve. As the primary stage 73 realizes a stop position of decreased spring counter-tension, continued counter-clockwise rotation of draw screw 114 begins movement in an opposite direction of the spring anchor 19. The starting point of this movement is adjusted by the lock-nut 115 which is threaded on the end of draw screw 114, rotated clockwise until contact is made with the rear surface of the secondary base 112 at a point which immediately follows the stop point of decreased spring counter-tension.

Referring to FIG. 8A, the third stop position is adjusted to correspond to a string tension created by the introduction of a predetermined thickness, provided by the chosen flat surface 102B.

Figure 9A:
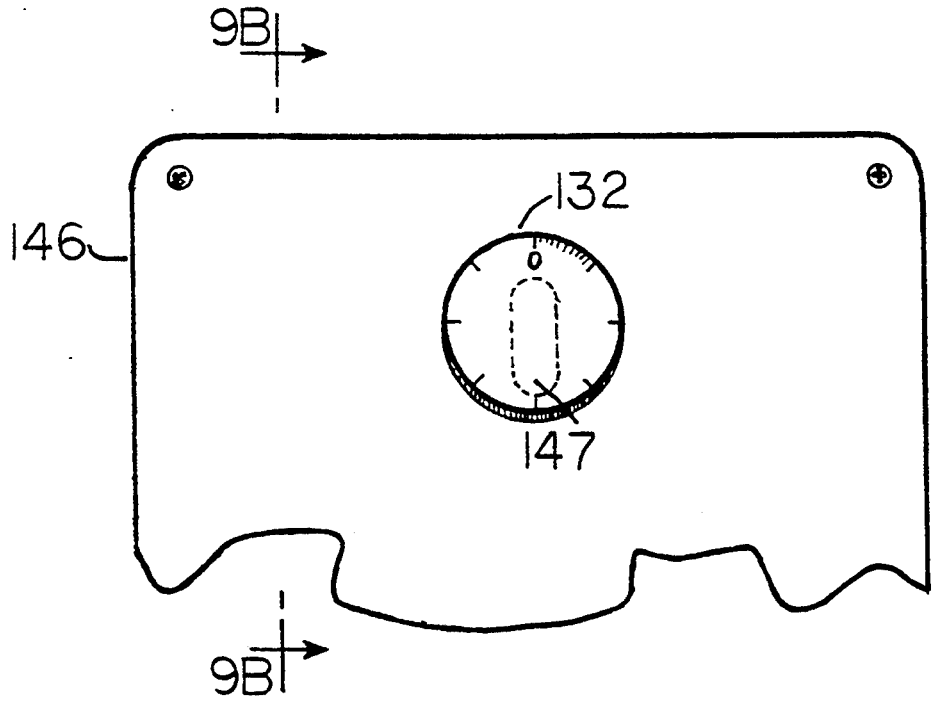
FIGS. 9A and 9B show an incremented tension correcting mechanism comprising a modification of part of the present invention.
Figure 9B:
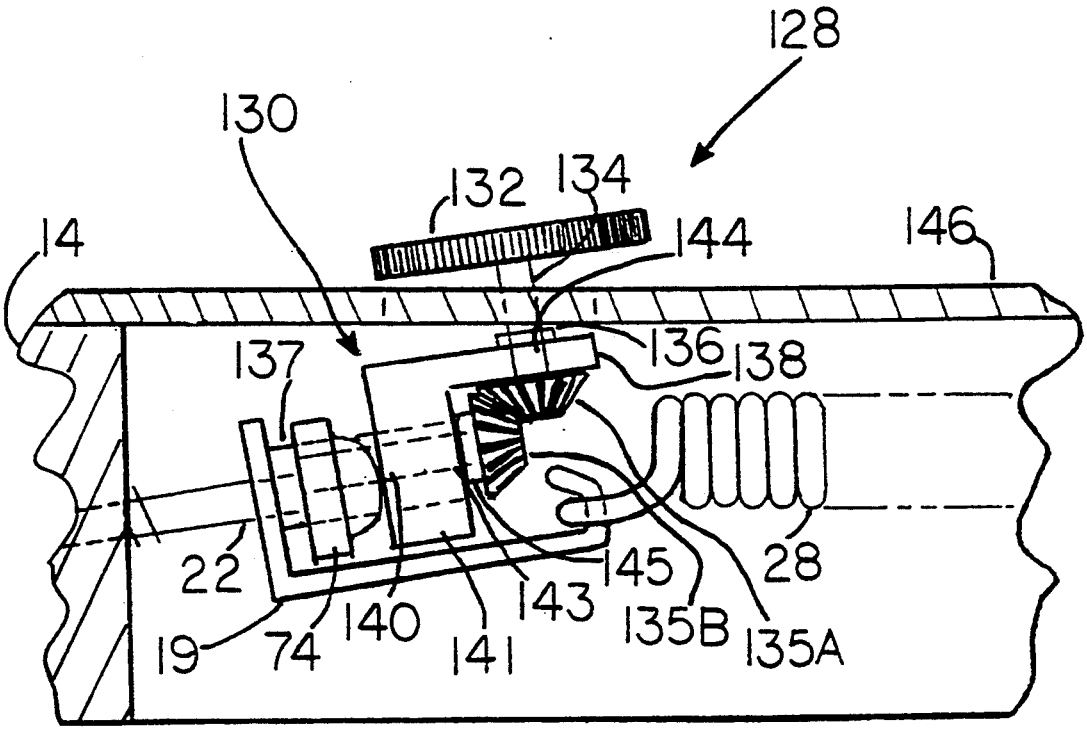

FIGS. 9A and 9B show an incremented tension correcting mechanism 128, in which visual monitoring of spring counter-threaded tension provides for numerous positions of spring counter-tension relating to changes of total string tension. An embodiment of this design is easily adjusted, and requires no separate tools for operation.

The incremented tension correction mechanism 128 includes the preferred embodiment elongated base 74 and a plunger block assembly 130 employing a pair of 45 degree beveled gears 135A and 135B for transferring rotation from an incremented dial 132, to a threaded shank 140, which is threaded into hole 78 of the elongated base 74, of the type shown in FIG. 3. A horizontally positioned bevel gear 135A is located underneath a bracket member 138, attached to the end of a shaft 134, and held by a collar 136. Bracket member 138 extends from the top of a block portion 141, and contains a central hole 143, in which shaft 134 is rotated and held in place by the collar 136. A second beveled gear 135B mounted vertically on the end of a threaded shank 140, engages with beveled gear 135A, mounted horizontally. Threaded shank 140 contains a washer 145 which lies between beveled gear 135B and the front of the block portion 141. The block portion 141 includes a set of fixed mounted plungers 137, which extend from the rear approximately 15 mm. The block portion 141 has dimensions generally 10 mm in thickness, 25 mm wide, and 15 mm in height, with bracket member 138 of the same width, 3 mm in thickness, 25 mm wide, and extending 12 mm from, the block portion 141.

Wood screws 22 attach the incremented tension correcting mechanism 128 to the guitar body 14, extending through the elongated base 74 and spring anchor 19. A zero position indicated by the dial 132 is designated as the mid-point for travel of the spring anchor 19, allowing movement toward or away from counter-tension springs 28, providing a positive or negative amount of spring counter-tension. A normal position of a tremolo is adjusted to the zeroed dial 132 by equal rotation of wood screws 22.

The dial 132 is incremented at 0.001 of an inch per graduation for positive and negative values for the amount of spring anchor 19 movement. For each gage string set installed on an instrument, there exists inherent values for the amount of spring counter-tension necessary to keep the strings in tune, with the addition to total string tension caused by the introduction of one or more predetermined thicknesses for distinct pitches. Thus, similar instruments equipped with identical gage string sets will correspond in adjusted values for amounts of spring counter-tension.

A cover plate 146 containing a slot 147 is used with the apparatus. Slot 147 provides clearance of the shaft 134, allowing for the movement of the plunger block assembly 130.

The present invention offers novel pitch changing capabilities for an instrument with a tremolo, significantly reducing time and effort required for achieving pitch changes with prior art. Further, a ratio of the relationship between string and string forces is maintained, adapting for various conditions of changed string tension.

Although a preferred embodiment has been disclosed herein illustrating the primary objects and operation of the present invention, it should be understood that the separate components may be used separately where an appropriate application exists. Therefore, additional functions may be performed without departing from the spirit of the invention.

What is claimed is:

1. A pitch changing apparatus for tremolos of the type used to vary in unison the pitch of a plurality of strings of a stringed musical instrument, having a body including a head, a sounding board and a plurality of tone producing strings stretched between said head and a bridge on the upper surface of said sounding board, said pitch changing apparatus affording means for independently varying the pitch of a selected string to a selected one of a plurality of predetermined discrete pitches, said apparatus comprising;

a. a tremolo bridge adapted to clampably hold the lower ends of a plurality of said tone-producing strings, said bridge adapted to pivotably mount to the upper surface of said sounding board of said stringed instrument, whereby said bridge may be pivoted rearward to increase tension and pitch of each of said plurality of strings, and forward to decrease such tension and pitch, said bridge having individual tuning mechanisms, each adapted to clampably hold at an adjustable predetermined tension the lower end of a separate one of said tone-producing strings, at least one of said tuning mechanisms including means for manually varying the tension and therefore pitch of a string held by said tuning mechanism to a selected one of a plurality of discrete values, each of said tuning elements comprising in combination a fixed front segment having an upper surface located above said upper surface of said sounding board and a transversely disposed rear surface, a rear segment including a front fulcrum portion, pivotably mounted to said front segment, a rear clamping block slidably movable with respect to said fulcrum portion and means for clamping said clamping block to said rear segment, thereby clamping the lower end of a string stretched over said upper and rear surfaces of said front segment between said rear surface of said front segment and said front surface of said clamping block, and b. a counter tensioning spring means connected between said tremolo bridge and said body of said instrument, said counter tensioning spring means being adapted to maintain constant the tension exerted on said plurality of strings in spite of variations in tension of a string whose pitch is varied to said selected one of a plurality of discrete values.

2. The apparatus of claim 1, wherein said means for clamping said slidable clamping block to said rear segment comprises in combination a rear vertically disposed wall on said rear segment, said wall having through the thickness dimension thereof a threaded hole, and a longitudinally disposed headed clamping screw threadably engaged in said hole and tightenable against the rear surface of said slidable clamping block.

3. The apparatus of claim 2 further including fine tuning means for smoothly varying the pitch of a selected one of said strings, said fine tuning means including in combination a flange plate extending rearward from said tremolo bridge, said flange plate having a generally horizontally disposed rear ledge, said ledge having through the thickness dimension thereof a vertically disposed threaded hole engaging a vertically disposed fine tuning screw, said fine tuning screw being tightenable against the shank of said longitudinally disposed clamping screw, thereby causing said rear segment of said tuning mechanism to pivot downwards with respect to said front segment, thereby increasing the tension and pitch of a string held within said tuning mechanism.

4. The apparatus of claim 3, wherein said means for manually varying the tension and pitch of a selected string to a selected one of a plurality of discrete values is further defined as comprising in combination a pitch shifting element slidably mounted on the rear portion of said longitudinally disposed clamping screw, said pitch shifting element being slidably mounted on the shank of said clamping screw and having a forcing surface at a predetermined radial distance from the longitudinal center line of said clamping screw, whereby said pitch shifting element may be slid forward on the shank of said clamping screw to a predetermined forward longitudinal position in which said forcing surface contacts the lower transverse surface of said fine tuning screw and exerts thereon an upwardly directed force, resulting in a downwardly directed reaction force causing said clamping screw and said pivotable rear segment of said tuning mechanism to pivot downward a predetermined distance, thereby increasing the tension and pitch of said string a predetermined amount.

5. The apparatus of claim 4 further including means for spring biasing said pitch shifting element in an upward position.

6. An apparatus of claim 5 further including detent means for maintaining said pitch shifting element in a longitudinally rearward, non-active position.

7. The apparatus of claim 4 wherein said pitch shifting element is further defined as being an elongated, generally cylindrical shaped body having through the length thereof a central longitudinally disposed coaxial bore slidably receiving the shank of said clamping screw, said body having at least one, first generally flat, longitudinally disposed surface, said body being slidable on said shank from a rearward, non-active position to a forward, active position in which said flat surface bears upwards against the bottom transverse surface of said fine tuning screw.

8. The apparatus of claim 7 wherein said pitch shifting element is further defined as having at least one additional generally flat, longitudinally disposed surface spaced at a radial distance from said central coaxial bore of said body different than the radial distance between said first flat surface and said bore, whereby said shifting element may be slid forward from a rear, non-active position to a selected one of a plurality of at least two forward, active positions in which a selected one of said generally flat, longitudinally disposed surfaces engages the lower transverse end wall of said fine tuning screw, thereby causing the tension and pitch of said string to be increased to a selected one of a plurality of predetermined values.

9. The apparatus of claim 7, wherein said pitch shifting element is further defined as having a longitudinally disposed tab continuous with a portion of the lower cylindrical wall surface of said cylindrical body, said tab having formed in the lower wall surface thereof a detent groove adapted to be engaged by a spring biased detent.

10. The apparatus of claim 1, wherein said counter tensioning spring means is further defined as comprising in combination at least one tension spring fastened at a first, rear end thereof to said pivotable base of said tremolo, a spring anchor fastened to the second, front end of said tension spring, said spring anchor being fastened to a first, adjusting bar, said adjusting bar being longitudinally slidably mounted to a second, anchor bar fastened to the underside of said body of said stringed instrument, whereby said spring anchor may move between two longitudinally spaced apart stop positions.

11. An improved tremolo apparatus for stringed instruments, said tremolo affording a capability for independently varying the pitch of a selected string to one of a plurality of predetermined discrete values, as well as varying the pitch of all of the strings in unison, said tremolo including;

a. a bridge having a base plate including means for pivotably attaching said base plate to the upper surface of the sounding board of a stringed instrument, said base plate having mounted on the upper surface thereof a plurality of string holders each adapted to hold in tension the rear end of a string, each of said string holders comprising a front longitudinally disposed segment including an upper wall surface that intersects a rear wall surface and a rear channel segment pivotably mounted to said front segment, said rear channel segment including a fulcrum portion, a rear clamping block longitudinally slidably contained within said rear channel segment, said rear channel segment having a vertically disposed rear wall provided through the thickness dimension thereof with a threaded hole threadably engaging a longitudinally disposed headed clamping screw tightenable against the rear surface of said clamping block to bear against the surface of a string strung over said fulcrum portion and hold said string clamped between said fulcrum portion and said clamping block, said base plate having fastened at a side thereof an elongated generally horizontally disposed, forward protruding operating arm, said arm may be pivotable upwards to increase in unison the tension and pitch of each string attached to said bridge, and pivoted downwards to decrease in unison the tension and pitch of each string attached to said bridge, said base plate having protruding rearward and upwardly from the rear edge thereof a flange plate having at the rear end portion thereof a generally horizontally disposed ledge, having through the thickness dimension thereof a vertically disposed threaded hole vertically aligned with the shank of one of said clamping screws, said hole threadably engaging a fine tuning screw tightenable against the shank of said longitudinally disposed clamping screw, thereby causing said clamping screw and said clamping block threadably engaged by said clamping screw, said channel member and said string clamped therein to pivot downwards, thereby increasing the tension and pitch of a selected string, said string holder having a pitch shifting member slidably mounted with respect to said longitudinally disposed clamping screw, said pitch shifting member having at least one generally flat, longitudinally disposed predetermined surface located a predetermined radial distance from the shank of said longitudinally disposed clamping screw, said pitch shifting member being slidable from a first, inactive position to an active position in which said flat surface is positioned between the shank of said clamping screw and the transverse end wall of the shank of said fine tuning screw and exert an upward force thereon, thereby causing a downward reaction force to be exerted transversely on said shank of said longitudinally disposed clamping screw and pivoting said shank downwards a predetermined distance, thereby increasing the tension of a selected string a predetermined amount and causing the pitch of said string to be increased a predetermined amount, and b. a counter tensioning spring mechanism connected between said pivotable base plate of said bridge and said body of said instrument, said counter tensioning spring mechanism being adapted to maintain constant the tension exerted on said plurality of springs in spite of variations in the tension of a selected string whose pitch is shifted a discrete amount, said spring mechanism including a first anchor bar attached to said body of said instrument, a second, slidable bar slidably movable an adjustable predetermined limit with respect to said anchor bar, a spring holder plate fastened to said slidable bar, and at least one tension spring fastened at a first, forward end thereof to said spring holder plate and at a second, rearward end thereof to said pivotable base plate of said bridge.

12. The tremolo apparatus of claim 11 wherein said pitch shifting member is further defined as being an elongated, generally cylindrically shaped body having through the length thereof a central coaxial bore adapted to slide on the shank of said longitudinally disposed clamping screw, said body having at least one flat, generally longitudinally disposed surface, said body being slidable from a first, inactive position not in forcible contact with the transverse lower edge wall of said fine tuning screw to a second, active position in which said generally flat surface contacts said transverse lower edge wall of said fine tuning screw and exerts thereon an upwardly directed force causing a predetermined downward deflection of said clamping screw.

13. The tremolo apparatus of claim 12, wherein said shifting member is further defined as having in the rear portion thereof a counter-bored hole sufficiently large to slidably receive the head of said longitudinally disposed clamping screw.

14. The apparatus of claim 13 further including detent means for maintaining said shifting element in a rearward, non-active position.

15. The apparatus of claim 13, wherein said detent means is further defined as comprising in combination a tab member continuous with and protruding forward from the lower wall surface of said body, said tab member having in the lower wall surface thereof a groove, and a leaf spring protruding upwards from said base plate of said bridge and adapted to engage said groove and exert an upwardly directed force on said tab member.

16. The apparatus of claim 13, wherein said pitch shifting member is further defined as having at least a second longitudinally disposed flat face spaced apart from the longitudinal axis of said body a radial distance different from that of said first flat face, whereby said shifting element may be rotated about its longitudinal axis to a selected one of at least two different force producing positions, thereby allowing selection of at least two predetermined pitch changes of said string.

17. The apparatus of claim 11, wherein said counter tensioning spring mechanism is further defined as including at least one additional anchor bar slidably mounted with respect to said first anchor bar, whereby said mechanism has three stops.

18. The apparatus of claim 11, wherein said counter tensioning spring mechanism is longitudinally adjustably fastened to said anchor bar by means of an elongated screw accessible through an access hole in the body of said instrument.

19. The apparatus of claim 11, wherein said slidable bar of said counter tensioning spring mechanism is longitudinally adjustably fastened to said anchor bar by means of an elongated screw having at one end thereof a lever that protrudes through a hole in the body of said instrument.

20. The apparatus of claim 11, wherein said slidable bar in said counter tensioning spring mechanism is longitudinally adjustably fastened to said anchor bar by means of a screw having attached to the head thereof a flexible cable protruding through the body of said instrument, the free end of said cable being provided with a thumb knob.

21. The apparatus of claim 18, wherein said slidable bar of said counter tensioning spring mechanism is longitudinally adjustably fastened to said anchor bar by means of a first bevel gear attached to one end of a longitudinally disposed screw, said first bevel gear engaging a second bevel gear attached to one end of a shaft protruding through the body of said instrument, said shaft having attached to the opposite end thereof an incrementally adjustable knob.

22. A tension correcting mechanism adapted to maintain constant an originally established ratio of spring and total string tensions exerted on a tremolo in spite of variations in total string tension, said tension correcting mechanism being fastenable between a pivotable base plate of a tremolo bridge and a body of a stringed instrument, and comprising in combination at least one tension spring fastened at a first, rear end thereof to said pivotable base plate of said tremolo bridge, and a spring anchor fastened to a second, front end of said tension spring, said spring anchor being fastened to a first, transversely disposed adjusting bar, said first adjusting bar being longitudinally slidably mounted to a second, anchor bar fastened to the underside of said body of said stringed instrument, whereby said spring anchor may move between two longitudinally spaced apart stop positions.

23. An improved tremolo apparatus for stringed instruments including pitch shifter means for independently varying the pitch of a selected string to a selected one of a plurality of predetermined discrete pitches, said apparatus comprising:

a. a tremolo bridge including means for clampably holding a plurality of tone-producing strings, and means for pivotably mounting said bridge to the upper surface of the body of a stringed instrument, said bridge having individual tuning mechanisms, at least one of said tuning mechanisms including pitch shifter means for manually varying the tension and therefore pitch of a string which is fastened to said bridge by said tuning mechanism, to a selected one of a plurality of discrete values, each of said tuning mechanisms comprising in combination a fixed front segment having a generally horizontally disposed upper surface that intersects a generally vertically disposed rear surface, a rear segment including a fulcrum portion, pivotably mounted to said front segment, the lower end of a string being stretched over said fulcrum portion and attached to said tuning mechanism behind the rear surface thereof, and b. fine tuning means for smoothly varying the pitch of a selected one of said strings, said fine tuning means including in combination a flange plate extending rearward from said tremolo bridge, said flange plate having a generally horizontally disposed rear ledge, said ledge having through the thickness dimension thereof a vertically disposed threaded hole engaging a vertically disposed fine tuning screw, said fine tuning screw being tightenable against a shank of a longitudinally disposed clamping screw, thereby causing said rear segment of said tuning mechanism to pivot downwards with respect to said front segment, thereby increasing the tension and pitch of a string held within said tuning mechanism.

24. The apparatus of claim 23, wherein said pitch shifter means is further defined as comprising in combination an elongated generally cylindrically shaped body having through the length thereof a central coaxial bore adapted to slide on the shank of said longitudinally disposed clamping screw, said body having at least one flat, generally longitudinally disposed surface adapted to slide from a rearward, non-active position to a forward, active position in which said flat surface bears upwards against the bottom transverse surface of said fine tuning screw, thereby causing the tension and pitch of said string to be increased to a selected one of a plurality of predetermined values.

* * * * *